US011353178B2

(12) United States Patent
Reich et al.

(10) Patent No.: US 11,353,178 B2
(45) Date of Patent: Jun. 7, 2022

(54) LIGHTING FIXTURES WITH LED MODULES CONFIGURED FOR TOOL-LESS ATTACHMENT

(71) Applicant: IDEAL Industries Lighting LLC, Sycamore, IL (US)

(72) Inventors: Steve Reich, Durham, NC (US); Mark P. Boomgaarden, Cary, NC (US); Daniel James Van Epps, Jr., Apex, NC (US)

(73) Assignee: IDEAL INDUSTRIES LIGHTING LLC, Durham, NC (US)

( * ) Notice: Subject to any disclaimer, the term of this patent is extended or adjusted under 35 U.S.C. 154(b) by 0 days.

(21) Appl. No.: 17/093,967

(22) Filed: Nov. 10, 2020

(65) Prior Publication Data

US 2022/0146064 A1 May 12, 2022

(51) Int. Cl.

| | |
|---|---|
| ***F21S 8/04*** | (2006.01) |
| ***F21S 8/02*** | (2006.01) |
| ***F21V 23/00*** | (2015.01) |
| ***F21V 19/00*** | (2006.01) |
| ***F21V 23/04*** | (2006.01) |
| ***F21S 9/02*** | (2006.01) |
| ***F21V 23/06*** | (2006.01) |
| *F21Y 115/10* | (2016.01) |

(52) U.S. Cl.

CPC ..... *F21S 8/026* (2013.01); *F21S 9/02* (2013.01); *F21V 19/004* (2013.01); *F21V 23/005* (2013.01); *F21V 23/04* (2013.01); *F21V 23/06* (2013.01); *F21Y 2115/10* (2016.08)

(58) Field of Classification Search

CPC ..... F21S 8/04; F21S 9/022; F21V 23/005; F21V 19/003; F21V 15/01

See application file for complete search history.

(56) References Cited

U.S. PATENT DOCUMENTS

| | | | | |
|---|---|---|---|---|
| 7,182,487 | B1 * | 2/2007 | Pickard | F21S 9/022 174/535 |
| 8,113,687 | B2 | 2/2012 | Villard et al. | |
| 9,494,294 | B2 | 11/2016 | Edmond et al. | |
| 9,521,727 | B1 * | 12/2016 | Clements | F21S 9/022 |
| 9,644,828 | B1 * | 5/2017 | May | F21K 9/275 |
| 9,699,856 | B2 * | 7/2017 | Roberts | H05B 47/125 |

(Continued)

*Primary Examiner* — Ismael Negron

(74) *Attorney, Agent, or Firm* — Withrow & Terranova, P.L.L.C.

(57) ABSTRACT

Lighting fixtures that include fixture housings and light-emitting diode (LED) modules configured for tool-less attachment and detachment to the fixture housings are disclosed. Certain LED modules include LED emitters, corresponding electronics for operating the LED emitters, and at least one shaped protrusion. Certain LED modules include safety tethers that are configured to provide mechanical support during the tool-less attachment and detachment. Lighting fixtures include a lens and removable endcaps that secure the lens to the fixture housing. Certain lighting fixtures include a backup battery and a button provided in one of the endcaps for testing the backup battery. Certain lighting fixtures include a cut-out portion in the fixture housing corresponding to the shaped protrusion of the LED module for providing identification of replacement LED modules that may be attached to fixture housings.

27 Claims, 11 Drawing Sheets

(56) References Cited

U.S. PATENT DOCUMENTS

| | | | | |
|---|---|---|---|---|
| 9,851,090 | B2 * | 12/2017 | Scribante | F21V 23/0442 |
| 9,874,333 | B2 * | 1/2018 | Lay | F21S 8/033 |
| 9,980,350 | B2 * | 5/2018 | Harris | H05B 47/18 |
| 9,989,224 | B2 * | 6/2018 | Ray | F21S 8/03 |
| 10,174,887 | B2 * | 1/2019 | Boulanger | F21V 21/03 |
| 10,228,111 | B2 | 3/2019 | Demuynck et al. | |
| 10,247,372 | B2 | 4/2019 | Wilcox et al. | |
| 10,274,171 | B2 * | 4/2019 | Goelz | F21V 14/04 |
| 10,302,262 | B2 * | 5/2019 | Huang | F21S 8/026 |
| 10,325,459 | B2 * | 6/2019 | Bagozzi | F21S 4/24 |
| 10,393,360 | B2 * | 8/2019 | Bailey | F21V 5/007 |
| 10,465,869 | B2 * | 11/2019 | Keller | F21S 8/006 |
| 10,663,129 | B1 * | 5/2020 | Zhong | F21V 3/00 |
| 11,035,527 | B1 * | 6/2021 | Lim | F21K 9/68 |
| 2006/0120073 | A1 * | 6/2006 | Pickard | F21S 9/022 362/217.13 |
| 2011/0211330 | A1 * | 9/2011 | Wang | F21V 15/013 362/20 |
| 2012/0033400 | A1 * | 2/2012 | Remus | F21S 9/022 362/20 |
| 2012/0306377 | A1 * | 12/2012 | Igaki | F21V 23/0471 315/151 |
| 2014/0355272 | A1 * | 12/2014 | Chou | F21S 4/28 362/308 |
| 2016/0286619 | A1 | 9/2016 | Roberts et al. | |
| 2017/0321852 | A1 * | 11/2017 | Handsaker | F21V 23/06 |

* cited by examiner

LIGHTING FIXTURES WITH LED MODULES CONFIGURED FOR TOOL-LESS ATTACHMENT

FIELD OF THE DISCLOSURE

The present disclosure relates to lighting fixtures, and more particularly to modular lighting fixtures.

BACKGROUND

Solid-state lighting devices such as light-emitting diodes (LEDs) are increasingly used in both consumer and commercial applications. Advancements in LED technology have resulted in highly efficient and mechanically robust light sources with long service life. Accordingly, modern LEDs have enabled a variety of new technologies and are being increasingly utilized in general illumination applications.

Unlike incandescent light sources that operate by subjecting a filament to a desired current, LED-based lighting fixtures require electronics to drive one or more LEDs. The electronics generally include a power supply and special control circuitry to provide uniquely configured signals that are required to drive the one or more LEDs in a desired fashion. The presence of the control circuitry adds a potentially significant level of intelligence to the lighting fixtures that can be leveraged to employ various types of lighting control. Such lighting control may be based on various environmental conditions, such as ambient light, occupancy, temperature, and the like as well as various user inputs.

In lighting environments that employ LED-based lighting fixtures, there is a need to properly illuminate an environment to desired lighting levels with desired color spectrums. Lighting designers are tasked with selecting the type, number, and placement of lighting fixtures and corresponding electronics for a particular implementation. After installation, sometimes needs may arise where it is desired for lighting fixtures to provide different lighting characteristics than what was initially provided.

The art continues to seek improved lighting devices providing desirable illumination characteristics capable of overcoming challenges associated with conventional lighting devices.

SUMMARY

The present disclosure relates to lighting fixtures, and more particularly to modular lighting fixtures. Lighting fixtures may include light-emitting diode (LED) modules that are configured for tool-less attachment and detachment with lighting fixture housings, thereby providing the ability to replace and upgrade lighting capabilities of existing lighting fixtures without requiring entire fixture replacement. LED modules may include LED emitters and corresponding electronics for operating the LED emitters. When an LED module is attached and detached in a tool-less manner, electrical and mechanical connections for the LED module may also be connected and disconnected in a tool-less manner without having to disconnect hardwired electrical connections. Lighting fixtures are also described that include identification structures for identifying compatible replacement LED modules. Additional lighting fixtures are disclosed that include removable endcaps that secure lenses to the lighting fixtures, where one or more of the endcaps may include an emergency backup generator test button.

In one aspect, a lighting fixture comprises: a fixture housing, wherein a portion of the fixture housing forms an electronics housing; and an LED module that is configured for tool-less attachment and detachment to electronics housing, the LED module comprising: at least one LED emitter on a frontside of the LED module, the at least one LED emitter operable to emit light when energized through an electrical path; and electronics for driving the at least one LED emitter, the electronics mounted on a backside of the LED module and positioned within the electronics housing when the LED module is attached. The lighting fixture may further comprise one or more mechanical fasteners within the electronics housing, the one or more mechanical fasteners configured to receive the LED module. In certain embodiments, the LED module comprises a module housing with one or more openings, and portions of the one or more mechanical fasteners reside within the openings when the LED module is attached. The one or more mechanical fasteners may comprise one or more retention clips. In certain embodiments, the one or more mechanical fasteners are attached to the electronics housing. In certain embodiments, the one or more mechanical fasteners are an integral single piece with the electronics housing. An overall height of the lighting fixture may be provided in a range from 4 inches to 5 inches and a height of the electronics housing may be provided in a range from 1 inch to 2 inches. In certain embodiments, the electronics comprise one or more of an LED driver, a transformer, and an emergency backup generator. In certain embodiments, the LED module further comprises one or more safety tethers that are configured to provide mechanical support during the tool-less attachment and detachment.

The lighting fixture may further comprise an electromechanical connector that is configured to provide electrical and mechanical connections for the LED module. In certain embodiments, the electromechanical connector comprises a receptacle that is mounted on one of the LED module and the electronics housing and a plug that is mounted on the other of the LED module and the electronics housing. In certain embodiments, the electromechanical connector provides tool-less attachment and detachment at a first location of the LED module and one or more mechanical fasteners provide tool-less attachment and detachment at a second location of the LED module.

The lighting fixture may further comprise an arrangement wherein the LED module forms a shaped structure and the fixture housing forms a corresponding cut-out portion that are configured to provide identification of replacement modules that may be attached to the fixture housing. In certain embodiments, the shaped structure comprises a protrusion from the LED module. In certain embodiments, the fixture housing forms a shaped structure and the LED module forms a corresponding cut-out portion that are configured to provide identification of replacement modules that may be attached to the fixture housing.

The lighting fixture may further comprise: a lens; a first endcap and a second endcap that are configured to releasably connect the lens to the fixture housing. In certain embodiments, one of the first endcap and the second endcap comprises an emergency battery test button. In certain embodiments, the other of the first endcap and the second endcap comprises a sensor module. In certain embodiments, the lighting fixture is a troffer-style lighting fixture.

In another aspect, a lighting fixture comprises: a fixture housing; and an LED module that is attached to the fixture housing, wherein the LED module comprises at least one protrusion that resides within a corresponding cut-out portion of the fixture housing to provide identification of the LED module. In certain embodiments, the LED module is configured for tool-less attachment and detachment to the fixture housing. In certain embodiments, the LED module further comprises: at least one LED emitter on a frontside of the LED module, the at least one LED emitter operable to emit light when energized through an electrical path; and electronics for driving the at least one LED emitter, the electronics mounted on a backside of the LED module and positioned within an electronics housing of the fixture housing.

In another aspect, a lighting fixture comprises: a fixture housing; an LED module that is attached to the fixture housing, the LED module comprising at least one LED emitter, a driver circuit for driving the at least one LED emitter, and an emergency backup generator for providing backup power to the at least one LED emitter; a lens; and a first endcap and a second endcap that are configured to releasably connect the lens to the fixture housing, wherein one of the first endcap and the second endcap comprises an emergency battery test button for the emergency backup generator. In certain embodiments, the LED module is configured for tool-less attachment and detachment to the fixture housing. In certain embodiments, the other of the first endcap and the second endcap comprises a sensor module. The other of the first endcap and the second endcap may also comprise one or more of a speaker, a microphone, a universal serial bus port, an odor-releasing device, and an indicator light. In certain embodiments, the lighting fixture is a troffer-style lighting fixture.

In another aspect, any of the foregoing aspects individually or together, and/or various separate aspects and features as described herein, may be combined for additional advantage. Any of the various features and elements as disclosed herein may be combined with one or more other disclosed features and elements unless indicated to the contrary herein.

Those skilled in the art will appreciate the scope of the present disclosure and realize additional aspects thereof after reading the following detailed description of the preferred embodiments in association with the accompanying drawing figures.

BRIEF DESCRIPTION OF THE DRAWING FIGURES

The accompanying drawing figures incorporated in and forming a part of this specification illustrate several aspects of the disclosure, and together with the description serve to explain the principles of the disclosure.

DETAILED DESCRIPTION

Figure 1A:
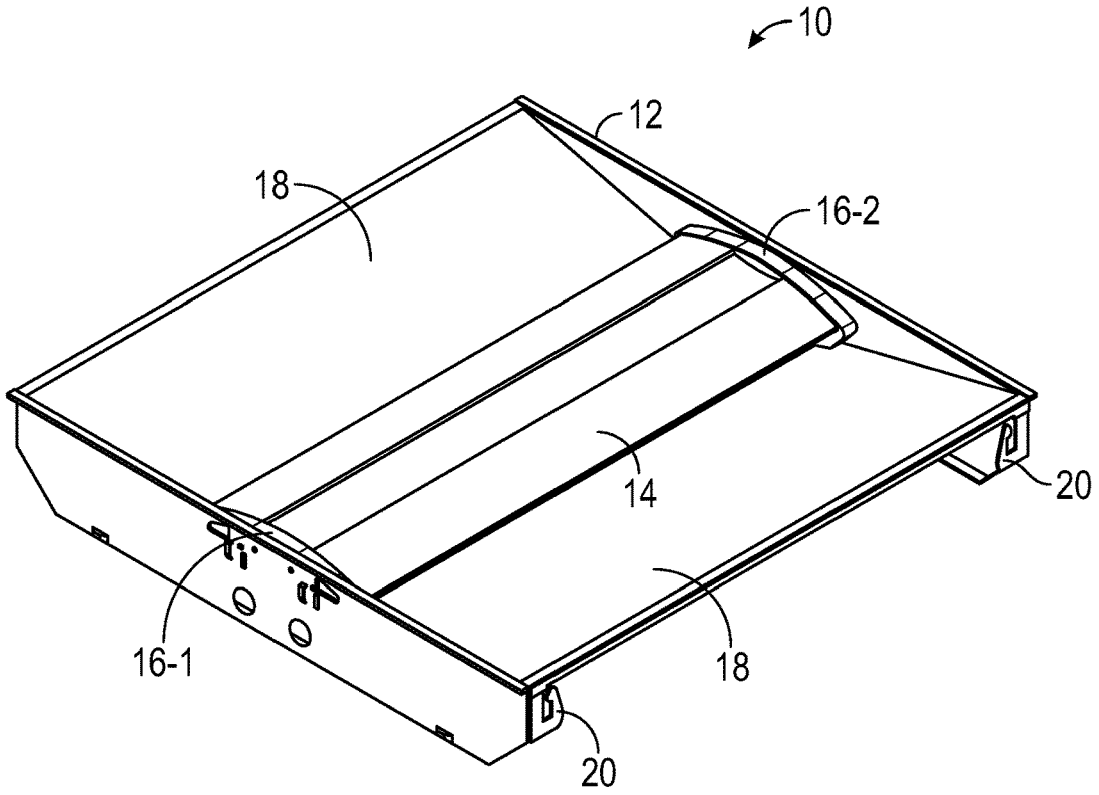
FIG. 1A is a frontside perspective view of a lighting fixture that is a troffer-style lighting fixture configured according to principles of the present disclosure.

The embodiments set forth below represent the necessary information to enable those skilled in the art to practice the embodiments and illustrate the best mode of practicing the embodiments. Upon reading the following description in light of the accompanying drawing figures, those skilled in the art will understand the concepts of the disclosure and will recognize applications of these concepts not particularly addressed herein. It should be understood that these concepts and applications fall within the scope of the disclosure and the accompanying claims.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present disclosure. As used herein, the term "and/or" includes any and all combinations of one or more of the associated listed items.

It will be understood that when an element such as a layer, region, or substrate is referred to as being "on" or extending "onto" another element, it can be directly on or extend directly onto the other element or intervening elements may also be present. In contrast, when an element is referred to as being "directly on" or extending "directly onto" another element, there are no intervening elements present. Likewise, it will be understood that when an element such as a layer, region, or substrate is referred to as being "over" or extending "over" another element, it can be directly over or extend directly over the other element or intervening elements may also be present. In contrast, when an element is referred to as being "directly over" or extending "directly over" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

Relative terms such as "below" or "above" or "upper" or "lower" or "horizontal" or "vertical" may be used herein to describe a relationship of one element, layer, or region to another element, layer, or region as illustrated in the Figures. It will be understood that these terms and those discussed above are intended to encompass different orientations of the device in addition to the orientation depicted in the Figures.

The terminology used herein is for the purpose of describing particular embodiments only and is not intended to be limiting of the disclosure. As used herein, the singular forms "a," "an," and "the" are intended to include the plural forms as well, unless the context clearly indicates otherwise. It will be further understood that the terms "comprises," "comprising," "includes," and/or "including" when used herein specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this disclosure belongs. It will be further understood that terms used herein should be interpreted as having a meaning that is consistent with their meaning in the context of this specification and the relevant art and will not be interpreted in an idealized or overly formal sense unless expressly so defined herein.

Embodiments are described herein with reference to schematic illustrations of embodiments of the disclosure. As such, the actual dimensions of the layers and elements can be different, and variations from the shapes of the illustrations as a result, for example, of manufacturing techniques and/or tolerances, are expected. For example, a region illustrated or described as square or rectangular can have rounded or curved features, and regions shown as straight lines may have some irregularity. Thus, the regions illustrated in the figures are schematic and their shapes are not intended to illustrate the precise shape of a region of a device and are not intended to limit the scope of the disclosure. Additionally, sizes of structures or regions may be exaggerated relative to other structures or regions for illustrative purposes and, thus, are provided to illustrate the general structures of the present subject matter and may or may not be drawn to scale. Common elements between figures may be shown herein with common element numbers and may not be subsequently re-described.

The present disclosure relates to lighting fixtures, and more particularly to modular lighting fixtures. Lighting fixtures may include light-emitting diode (LED) modules that are configured for tool-less attachment and detachment with lighting fixture housings, thereby providing the ability to replace and upgrade lighting capabilities of existing lighting fixtures without requiring entire fixture replacement. LED modules may include LED emitters and corresponding electronics for operating the LED emitters. When an LED module is attached and detached in a tool-less manner, electrical and mechanical connections for the LED module may also be connected and disconnected in a tool-less manner without having to disconnect hardwired electrical connections. Lighting fixtures are also described that include identification structures for identifying compatible replacement LED modules. Additional lighting fixtures are disclosed that include removable endcaps that secure lenses to the lighting fixtures, where one or more of the endcaps may include an emergency backup generator test button.

The expressions "lighting device," "lighting fixture," "lighting apparatus," "light emitting device," "light emitting fixture," and "light emitting apparatus" as used herein are not limited, except that such elements are capable of emitting light. That is, a lighting device, fixture, or apparatus can be a device which illuminates an area or volume, e.g., any indoor area or volume, and any outdoor area or volume. Lighting devices, fixtures, and apparatuses as disclosed herein may include troffers, downlights, suspending lighting, high-bay, low-bay, light bulbs, bulb replacements (e.g., for replacing AC incandescent lights, low voltage lights, fluorescent lights, etc.), outdoor lighting, street lighting, security lighting, exterior residential lighting (wall mounts, post/column mounts), ceiling fixtures/wall sconces, under cabinet lighting, lamps (floor and/or table and/or desk), landscape lighting, track lighting, task lighting, specialty lighting, ceiling fan lighting, archival/art display lighting, high vibration/impact lighting-work lights, etc., mirrors/vanity lighting, or any other light emitting devices. In certain embodiments, a lighting device may also be referred to as a lighting fixture.

While aspects of the present disclosure are provided in the context of a troffer-style lighting fixture, the principles of the present disclosure are equally applicable to any of the lighting fixtures mentioned above.

FIG. 1A is a frontside perspective view of a lighting fixture 10 that is a troffer-style lighting fixture configured according to principles of the present disclosure. The lighting fixture 10 comprises a troffer or fixture housing 12 that may be removably attached within a ceiling grid or other suitable support structure. For example, troffer-style lighting fixtures may typically be configured for mounting into a drop ceiling (not shown) of a commercial, educational, or governmental facility. The lighting fixture 10 includes an optic 14 which may form a mixing chamber that encloses a light source for the lighting fixture 10, such as an array of solid state emitters (e.g., LED emitters). In some circumstances, a light engine and/or additional electronics may also be arranged underneath the optic 14. A first endcap 16-1 and a second endcap 16-2 may be disposed at either end of the optic 14 to facilitate mounting and attachment of the optic 14 to the fixture housing 12. In certain embodiments, one or more of the optic 14 and the endcaps 16-1, 16-2 may be configured to be snap-fit or even magnetically attached to the fixture housing 12. Panels 18 that may include reflective surfaces are arranged on either side of the optic 14. In this manner, the panels 18 may be referred to as reflective panels. The panels 18 may be arranged at an angle on either side of the optic 14 for redirecting light in a desired direction. In certain embodiments, the panels 18 may provided as an integral single piece of the fixture housing 12, while in other embodiments, the panels 18 are separately formed and attached to or otherwise incorporated into the fixture housing 12. The fixture housing 12 may also support various other electronics and devices such as one or more of a driver, a power supply, control circuitry, an ambient light sensor, an occupancy sensor, or other types of sensors, a camera, and the like. The lighting fixture 10 may typically be mounted in an overhead orientation such that light emissions are provided in a generally downward direction; however, the lighting fixture 10 may have other orientations. In this regard, one or more mounting clips 20 may be provided that secure the lighting fixture 10 in an overhead position along a ceiling, such as to a ceiling grid support structure. The mounting clips 20 may be formed integrally with the fixture housing 12 or the mounting clips 20 may embody separate parts that are attached to the fixture housing 12. In FIG. 1A, the mounting clips 20 are oriented in a direction parallel with a direction of the optic 14 as provided between the endcaps 16-1, 16-2. In other configurations, the mounting clips 20 may be oriented perpendicular with the direction of optic 14, or a portion of the mounting clips 20 may be bent perpendicular with the direction of the optic 14.

Figure 1B:
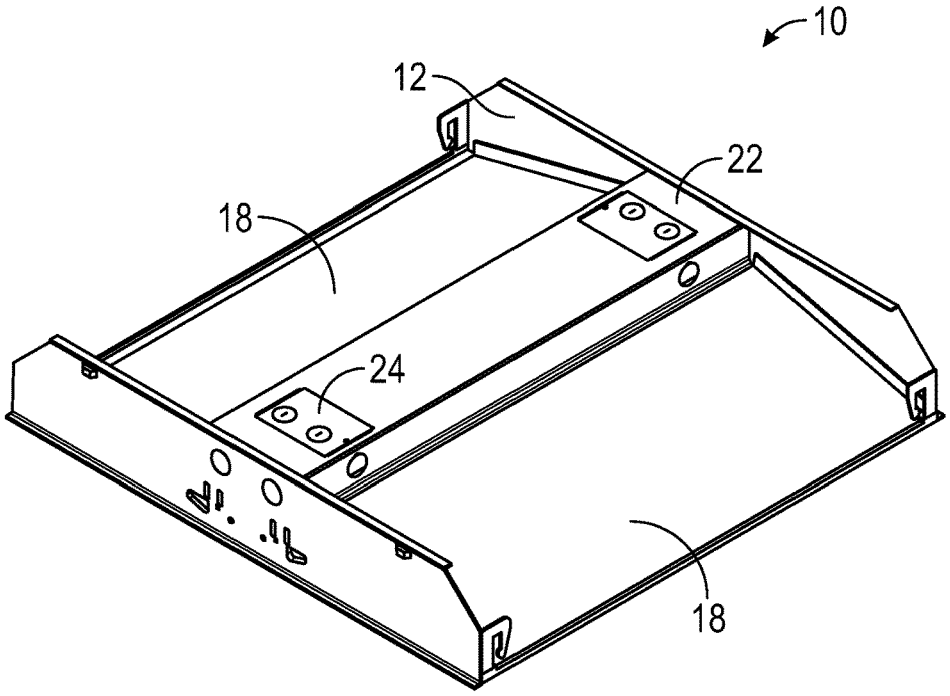
FIG. 1B is a backside perspective view of the lighting fixture of FIG. 1A.

FIG. 1B is a backside perspective view of the lighting fixture 10 of FIG. 1A. An electronics housing 22 is provided on the backside of the lighting fixture 10. The electronics housing 22 may embody a portion of the overall fixture housing 12 of the lighting fixture 10. By way of example, the electronics housing 22 is shown mounted centrally between the panels 18 and along an entire length of the panels 18. In other configurations, the electronics housing 22 may only partially extend along a length of the panels 18. The electronics housing 22 may be utilized to house all or a portion of electronics that are used to power and control the LED emitters of the lighting fixture 10. In this manner, the electronics housing 22 may form a junction box that is integrated with the lighting fixture 10 for providing a high voltage enclosure. By way of example, the electronics may include one or more driver circuits or modules that power the light sources. Suitable driver circuits are compact enough to fit within the electronics housing 22, while still providing suitable power delivery and control capabilities necessary to drive the LED emitters. At a basic level, an exemplary driver circuit may embody an AC to DC converter, a DC to DC converter, or both. For embodiments where the lighting fixture 10 includes more advanced communication and/or sensor capabilities, the electronics may further comprise one or more communications circuits or modules that facilitate wired and/or wireless communications with one or more of other lighting fixtures, a remote control system, and a portable handheld commissioning tool. In certain embodiments, the electronics housing 22 may be integrally formed as a single piece with the fixture housing 12 while in other embodiments, the electronics housing 22 may embody a separate piece that is attached to the fixture housing 12. The electronics housing 22 may further include one or more access ports 24 that are provided for receiving external electrical connections.

Figure 2:
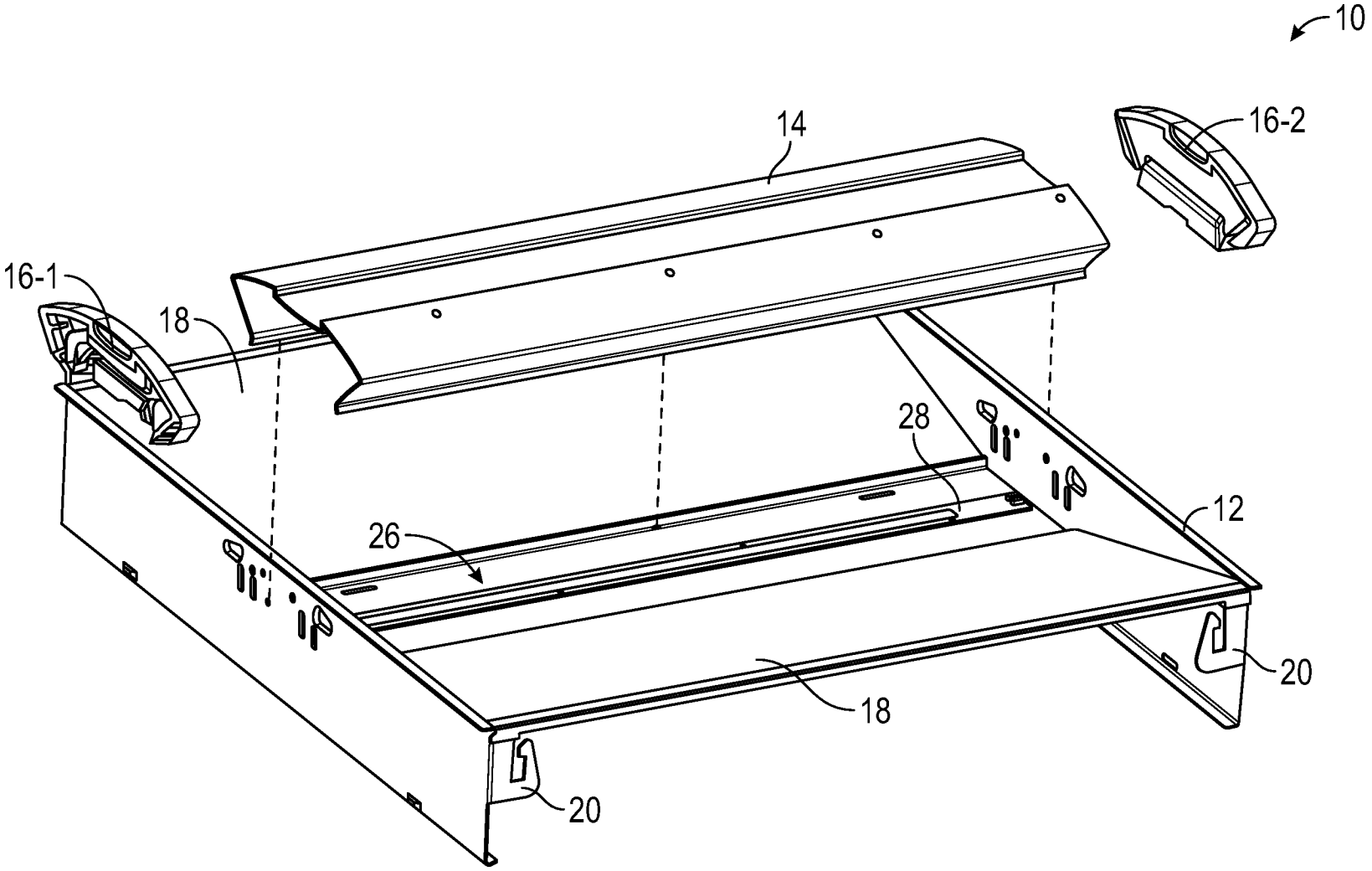
FIG. 2 is a partially exploded perspective view of the frontside of the lighting fixture of FIG. 1A where an optic and endcaps are illustrated above a housing to provide a view of a light-emitting diode (LED) module that resides underneath the optic.

FIG. 2 is a partially exploded perspective view of the frontside of the lighting fixture 10 of FIG. 1A where the optic 14 and the endcaps 16-1, 16-2 are illustrated above the fixture housing 12 to provide a view of an LED module 26 that resides underneath the optic 14. The endcaps 16-1, 16-2 may be configured to snap-fit or otherwise releasably attach on opposing ends of the optic 14, and then the endcaps 16-1, 16-2 may be snap-fit or otherwise be removably or releasably attached to the fixture housing 12. In this manner, the optics 14 and the endcaps 16-1, 16-2 may be readily removed in a tool-less manner to access the LED module 26. In certain aspects, this provides an end user the ability to change the optic 14 to a different optic having a different shape, such as round or rectangular shape in cross-section, without having to replace the entire lighting fixture 10. Additionally, the end user may also be able to readily change one or more of the endcaps 16-1, 16-2 with other endcaps that provide additional functionality, such as an endcap that includes a sensor. The LED module 26 may comprise an LED board 28 where a number of LED emitters may be arranged in a linear manner underneath the optic 14, the LED emitters being operable to emit light when energized through an electrical path. The LED module 26 may reside at least partially within the electronics housing 22 of FIG. 1B.

Figure 3A:
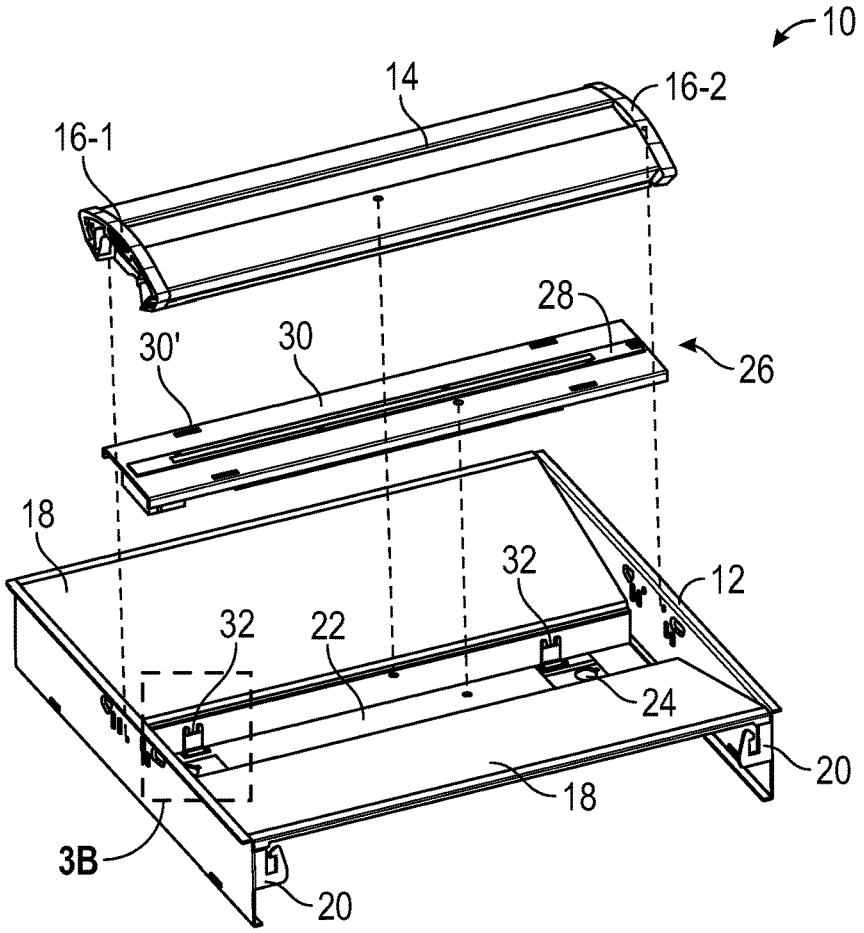
FIG. 3A is a partially exploded perspective view of the frontside of the lighting fixture of FIG. 2 where the LED module is shown above the housing to illustrate a configuration where the LED module may be releasably attached according to principles of the present disclosure.

FIG. 3A is a partially exploded perspective view of the frontside of the lighting fixture 10 of FIG. 2 where the LED module 26 is shown above the fixture housing 12 to illustrate a configuration where the LED module 26 may be removably attached according to principles of the present disclosure. With the LED module 26 shown above the fixture housing 12, the electronics housing 22 is visible between the panels 18. As illustrated, the LED module 26 forms a size and shape that allows it to fit within the electronics housing 22 as provided in FIG. 2. The LED module 26 includes a module housing 30 that supports the LED board 28. The module housing 30 may form one or more openings 30' that are configured to facilitate removable attachment within the lighting fixture 10. In the example of FIG. 3A, the openings 30' are configured to facilitate removable attachment with one or more corresponding retention clips 32 that are arranged within the electronics housing 22.

Figure 3B:
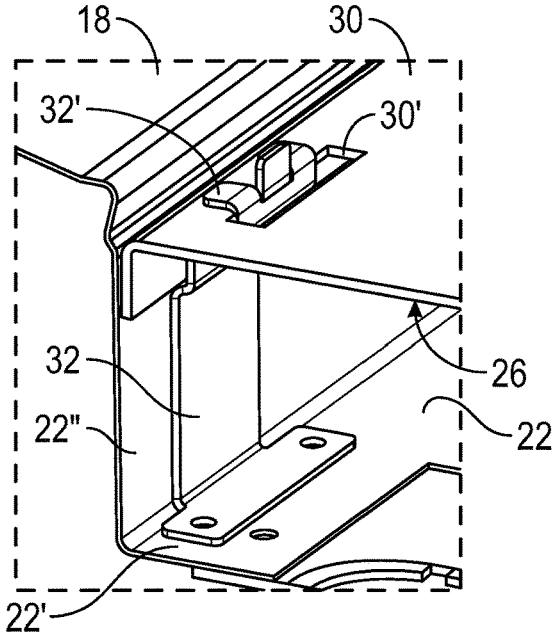
FIG. 3B is a magnified view of a portion of the lighting fixture taken from a portion of FIG. 3A as indicated by a dashed line box of FIG. 3A.

FIG. 3B is a magnified view of a portion of the lighting fixture 10 taken from the dashed line box labeled 3B of FIG. 3A. In the view provided by FIG. 3B, the LED module 26 of FIG. 3A may be snap-fit within the electronics housing 22. For illustrative purposes, portions of the fixture housing 12 are omitted. When attached, the opening 30' of the module housing 30 may receive a portion of the retention clip 32 to secure the module housing 30. The retention clip 32 may comprise a separate piece that is first secured to the electronics housing 22 in a position that is aligned with the openings 30'. In other configurations, the retention clip 32 may be formed as an integrated single piece with the electronics housing 22. In certain embodiments, a portion of the retention clip 32 may be secured or integral with a floor 22' of the electronics housing, and a different portion of the retention clip 32 may be secured or integral with a sidewall 22" of the electronics housing 22. In other embodiments, the entire retention clip 32 may be secured or integral with only one of the floor 22' or sidewall 22" of the electronics housing 22. A portion of the retention clip 32 may form a lip 32' that further secures the module housing 30. The retention clip 32 as illustrated in FIG. 3B is provided as only a particular example of how to provide removable attachment for the LED module 26 within the electronics housing 22. In practice, the retention clip 32 may embody any fastening structure that allows the LED module 26 to be releasably attached to the lighting fixture 10 without having to replace the entire lighting fixture 10. Additionally, such fastening structures may advantageously provide quick release and tool-less attachment and detachment. In this regard, the terms "releasably attached" or "removably attached" as used herein refer to tool-less and/or hand-release attachment and detachment between two structures. In various configurations, the fastening structures (e.g., retention clip 32 of FIG. 3B) may comprise straight engagement or rotational engagement structures. In particular embodiments, the electronics housing 22 may remain with the lighting fixture 10 when the LED module 26 is removed, thereby allowing replacement and/or upgrading of the LED module 26 independently of the electronics housing 22. As will be later described in more detail, the LED module 26 and the electronics housing 22 may be configured such that electrical connections for the LED module 26 are simultaneously connected with attachment and simultaneously disconnected with detachment of the LED module 26.

Figure 4:
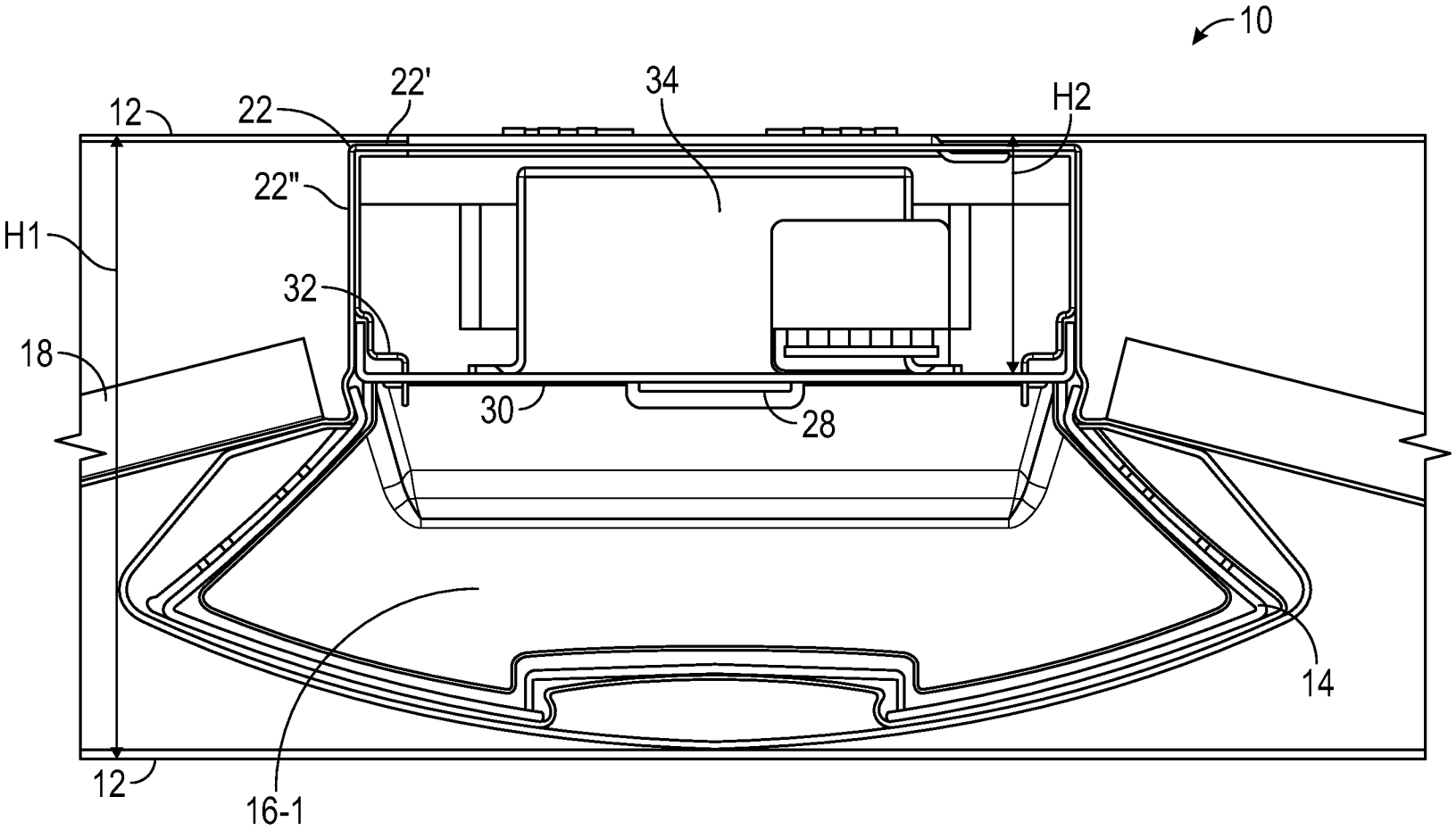
FIG. 4 is a cross-section view of a portion of the lighting fixture of FIGS. 3A and 3B at an endcap that further illustrates a position of electronics within an electronics housing.

FIG. 4 is a cross-section view of a portion of the lighting fixture 10 of FIGS. 3A and 3B at the endcap 16-1 that further illustrates a position of electronics 34 within the electronics housing 22. Portions of the fixture housing 12 are omitted for illustrative purposes. In FIG. 4, the retention clips 32 are illustrated as secured or integral with only a sidewall 22" of the electronics housing 22. In other embodiments, the retention clips 32 may be arranged as provided in FIG. 3B. As illustrated, at least a portion of the electronics 34 may be mounted on a face of the module housing 30 that is opposite the LED board 28. In this manner, when the module housing 30 is releasably attached within the electronics housing 22, the electronics 34 resides within electronics housing 22. Depending on the application, such a configuration may provide a low profile for the lighting fixture 10 while also providing removable attachment capabilities. By way of example, an overall height H1 of the lighting fixture 10 may be less than 5 inches, or less than 4.5 inches, or in a range from 4 inches to 5 inches, or in a range from 4 inches to 4.5 inches. In such embodiments, a height H2 of the electronics housing 22 as measured from the module housing 30 may be less than 2 inches, or in a range from 1 inch to 2 inches. In a particular example, the height H1 may be in a range from 4 inches to 4.3 inches and the height H2 may be in a range from 1.4 inches to 1.6 inches.

Figure 5A:
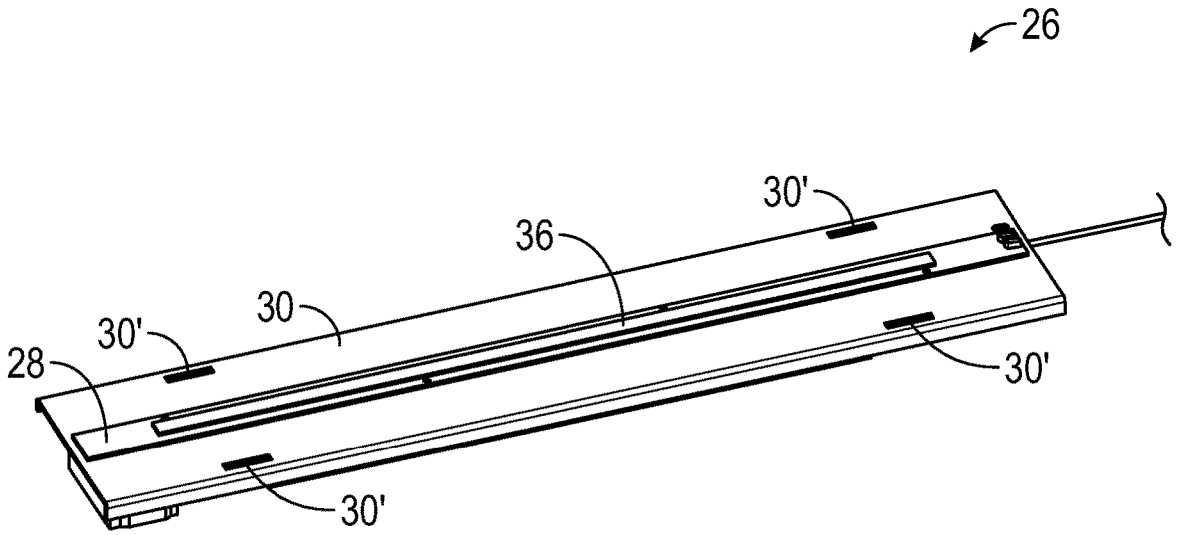
FIG. 5A is a frontside perspective view of the LED module of FIG. 3A.

FIG. 5A is a frontside perspective view of the LED module 26 of FIG. 3A. As illustrated, the LED board 28 is supported or otherwise mounted to the frontside of the module housing 30. In certain embodiments, the LED board 28 is arranged in a linear manner from one end of the module housing 30 to the other. The LED board 28 may include an LED emission area 36 that includes a number of LED emitters, the emission characteristics of which are selected for a particular lighting application. In certain applications, the LED emitters may collectively be referred to as an LED light engine. In the LED module 26 of FIG. 3A, four of the openings 30' are formed near perimeter edges of the module housing 30, with two of the openings 30' being provided adjacent opposing long edges of the module housing 30.

Figure 5B:
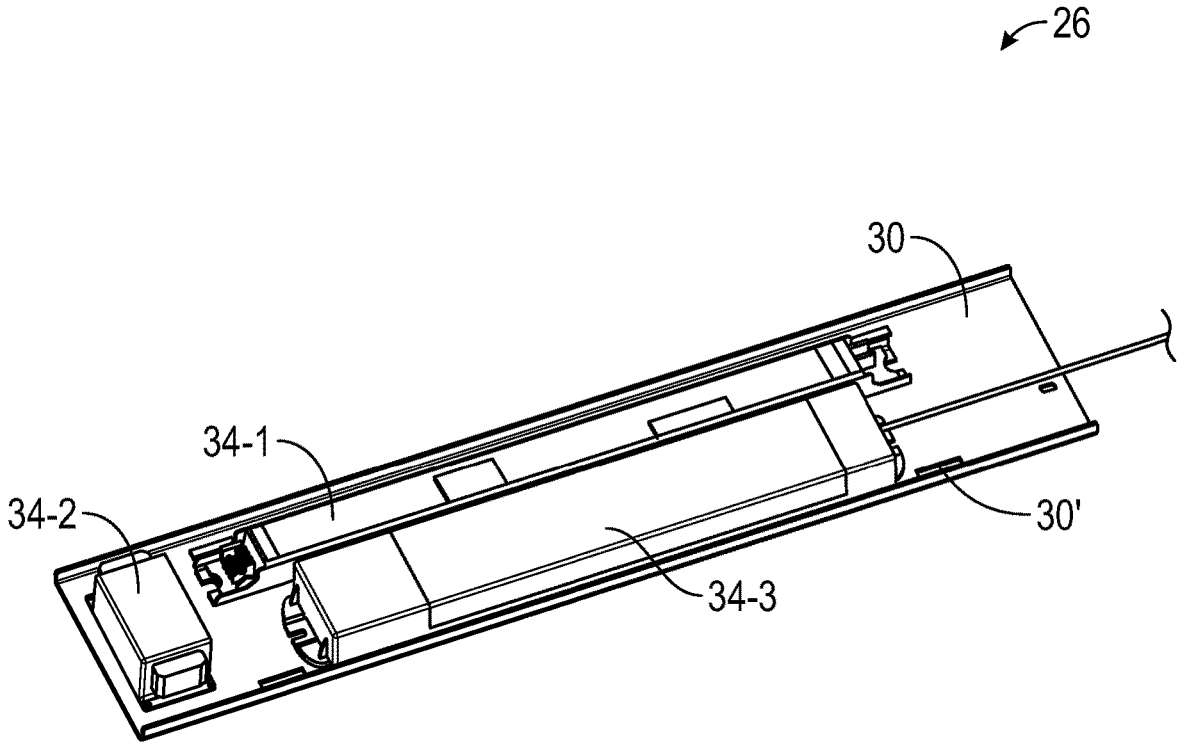
FIG. 5B is a backside perspective view of the LED module of FIG. 5A that provides a detailed view of one or more electronics that may be supported or otherwise mounted to the backside of the LED module.

FIG. 5B is a backside perspective view of the LED module 26 of FIG. 5A that provides a detailed view of one or more electronics 34-1 to 34-3 that may be supported or otherwise mounted to the backside of the LED module 26. By way of example, the electronics 34-1 to 34-3 may comprise an LED driver 34-1, a transformer 34-2, and an emergency backup generator or battery 34-3. In practice, the electronics 34-1 to 34-3 may include additional components and circuitry. By providing the electronics 34-1 to 34-3 on the backside of the module housing 30 opposite the LED board 28, the LED module 26 may be releasably attached such that the electronics 34-1 to 34-3 are contained within the electronics housing 22 and the LED emission area 36 is oriented in a desired emission direction. In certain embodiments, the LED module 26 of FIGS. 5A and 5B may embody any number of LED modules that are configured to provide one or more different emission characteristics, electrical characteristics, and advanced communication capabilities for the exemplary lighting fixture 10 of FIG. 3A. By providing each of the LED modules 26 with a common footprint, including a position of the openings 30', different ones of the LED modules 26 may be used to replace or upgrade an existing lighting fixture without requiring complete removal and/or re-wiring of the existing lighting fixture.

Figure 6A:
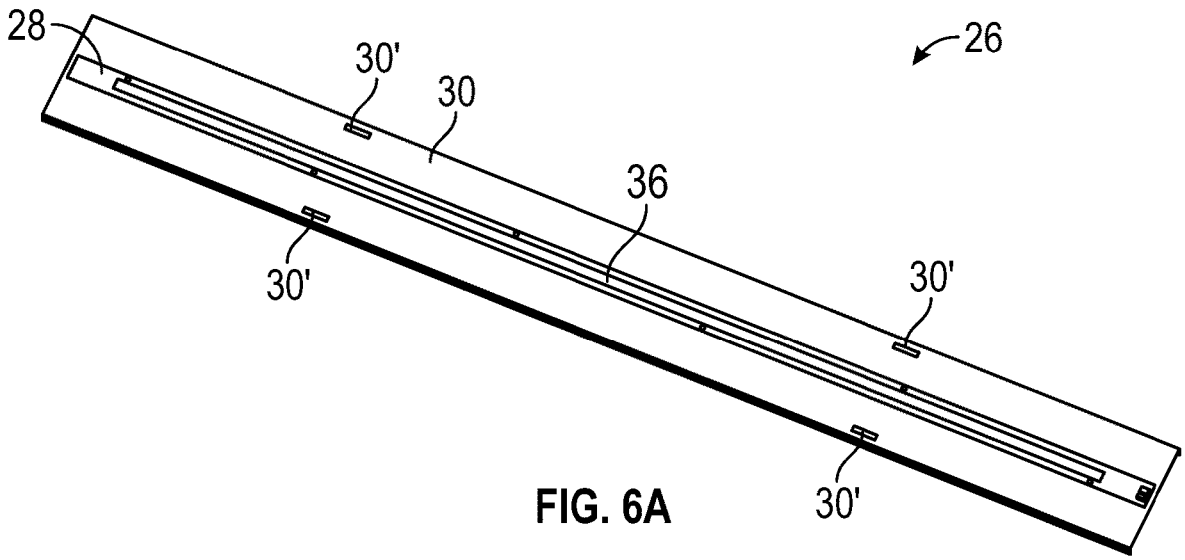
FIG. 6A is a frontside perspective view of an alternative configuration of the LED module of FIG. 5A according to principles of the present disclosure.
Figure 6B:
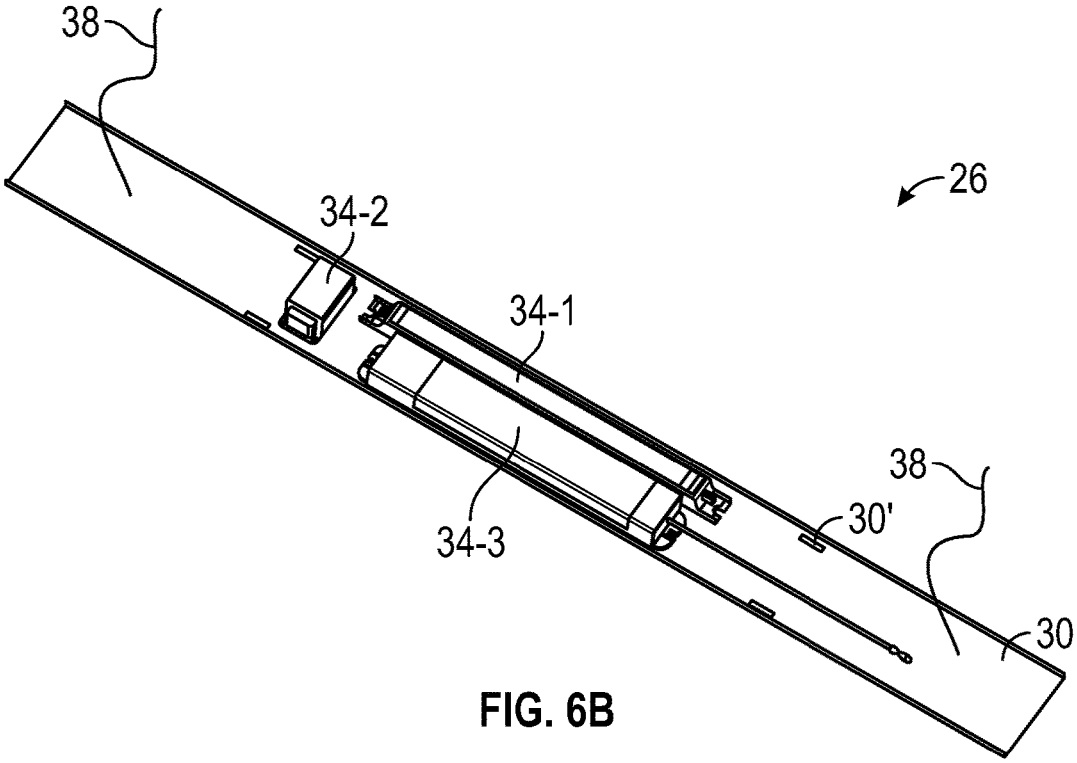
FIG. 6B is a backside perspective view of the LED module of FIG. 6A that provides a detailed view of one or more safety tethers that may be provided according to principles of the present disclosure.

FIG. 6A is a frontside perspective view of an alternative configuration of the LED module 26 of FIG. 5A according to principles of the present disclosure. FIG. 6B is a backside perspective view of the LED module 26 of FIG. 6A that provides a detailed view of one or more safety tethers 38 that may be provided according to principles of the present disclosure. In certain applications, the safter tethers 38 may be provided on the backside of the module housing 30 to assist supporting the LED module 26 during attachment or detachment. For example, a user may remove the LED module 26 by first releasing the mechanical retention (e.g., the retention clips 32 of FIG. 3B) from the openings 30', followed by releasing the safety tethers 38 thereafter. For installation, the process may be repeated in reverse. In this regard, the safety tethers 38 provide mechanical support during attachment of detachment of the LED module 26. In certain embodiments, the safety tethers may comprise one or more of wire clips, spring clips, flexile metal cabling, and wires or cabling with attachment hooks.

Figure 7A:
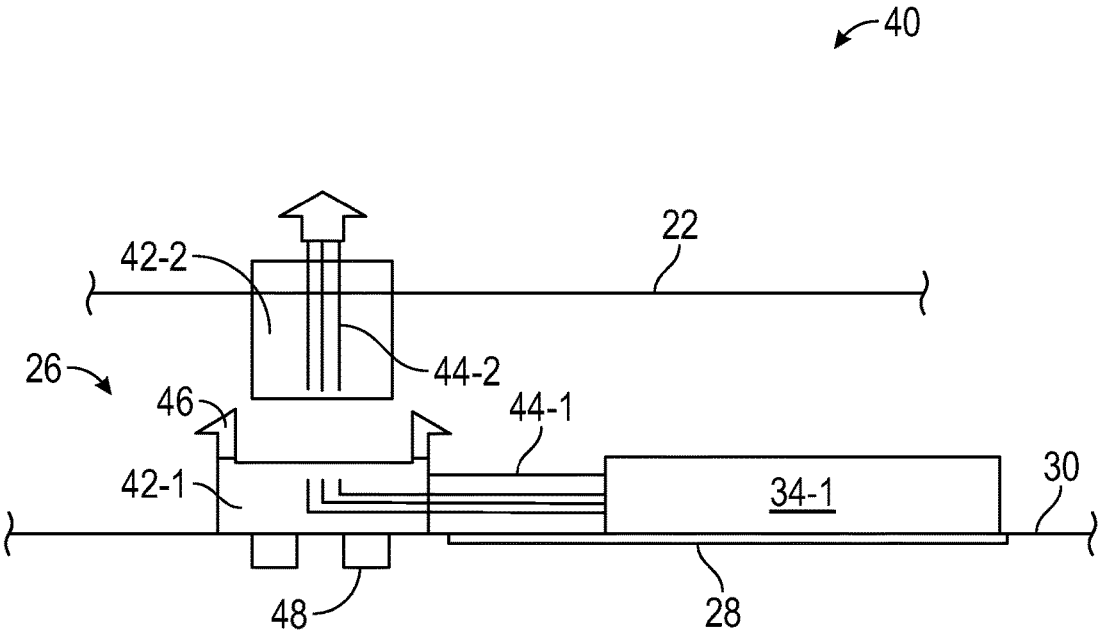
FIG. 7A is a cross-section view of a portion of a lighting fixture that is similar to the lighting fixture of FIG. 3A and further illustrates details of an electromechanical connector for the LED module.

As previously described for the lighting fixture 10 of FIGS. 3A and 3B, electrical connections for LED modules of the present disclosure may be simultaneously connected with attachment and simultaneously disconnected with detachment of the LED modules. FIG. 7A is a cross-section view of a portion of a lighting fixture 40 that is similar to the lighting fixture 10 of FIG. 3A and further illustrates details of an electromechanical connector for the LED module 26. By way of example, the electromechanical connector may include a receptacle 42-1 formed on the LED module 30 and a corresponding plug 42-2 that is formed on the electronics housing 22. In other embodiments, the order may be reversed such that the receptacle 42-1 is provided on the electronics housing 22 and the plug 42-2 is provided on the module housing 30. The receptacle 42-1 and the plug 42-2 may each comprise corresponding wirings 44-1, 44-2, that when connected, provide an electrical connection to the LED board 28. In addition to electrical connections, the wirings 44-1, 44-2 may further include communications wiring for the lighting fixture 40. In this regard, a tool-less electrical and mechanical connection is provided when the LED module 26 is releasably attached. One or more of the receptacle 42-1 and the plug 42-2 may include an attachment structure 46 that helps secure the plug 42-2 to the receptacle 42-1. The attachment structure 46 may comprise a tab or clip that snaps into place. One or more of the receptacle 42-1 and the plug 42-2 may also include a release structure 48, that allows the receptacle 42-1 and the plug 42-2 to be detached from one another without the use of tools. For example, the release structure 48 may comprise a threaded portion that allows a twist release within the receptacle 42-1 or a tab that releases engagement with the attachment structure 46.

Figure 7B:
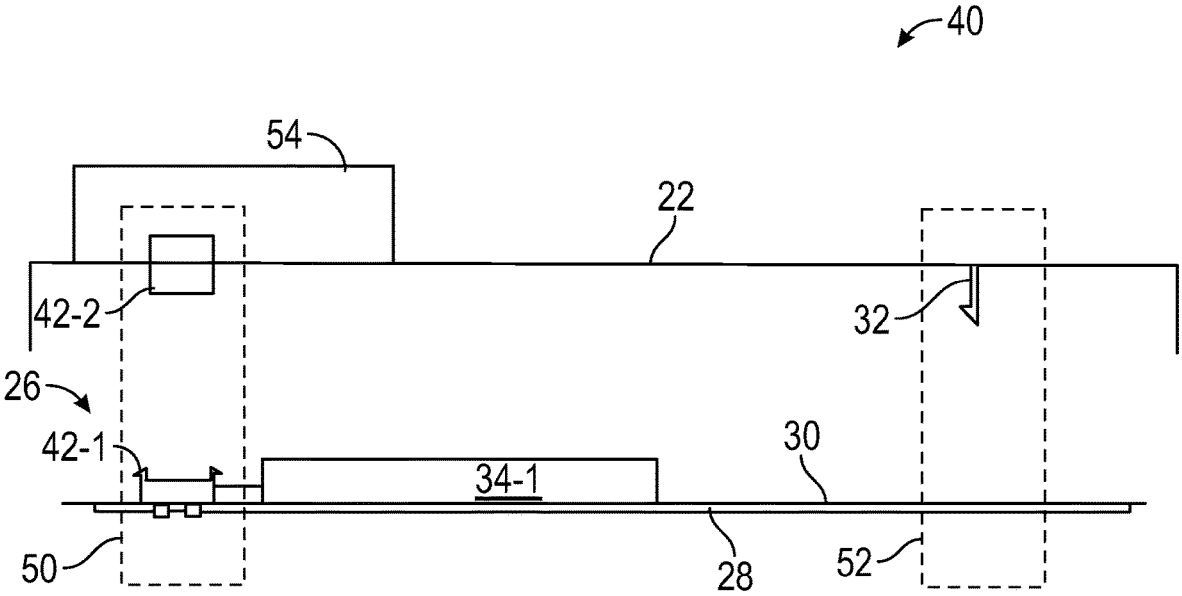
FIG. 7B is a cross-section view of a larger portion of the lighting fixture of FIG. 7A.

FIG. 7B is a cross-section view of a larger portion of the lighting fixture 40 of FIG. 7A. As illustrated, the LED module 26 may be mechanically and electrically attached to the electronics housing 22 in a first location 50 as indicated by the dashed-line box at the left side of FIG. 7B. The LED module 26 may further be mechanically attached to the electronics housing 22 in a second location 52 as indicated by the dashed-line box at the right side of FIG. 7B. By way of example, the mechanical attachment at the second location 52 may comprise one or more of the retention clips 32 or other mechanical fasteners as previously described. The lighting fixture 40 be electrically coupled to a wiring box or compartment 54 that provides hard-wired electrical connections to the plug 42-2. In this manner, the LED module 26 may be safely attached and detached from the lighting fixture 40 without requiring that the hard-wired electrical connections be exposed. As such, the LED module 26 may be hot-swappable without the risk of electrical shock from hard-wired electrical connections, thereby avoiding costs of using licensed electricians.

Embodiments of the present disclosure provide lighting fixtures that allow LED modules to be easily replaced and/or upgraded after the lighting fixtures have been installed. In certain embodiments, it may be beneficial to provide shaped structures within the lighting fixture that ensure compatible LED modules are being used as replacements. Such structures may include providing one or more unique shapes for the LED modules and corresponding shapes for receiving the LED module within the fixture housing. In this manner, an end user may not be able to install an LED module that is mismatched with the corresponding lighting fixture. Additionally, shaped structures may further provide an identifier for distinguishing genuine LED modules from counterfeit ones that may enter the marketplace. In other embodiments, the shaped structures may further provide alignment structures for attachment of LED modules.

Figure 8A:
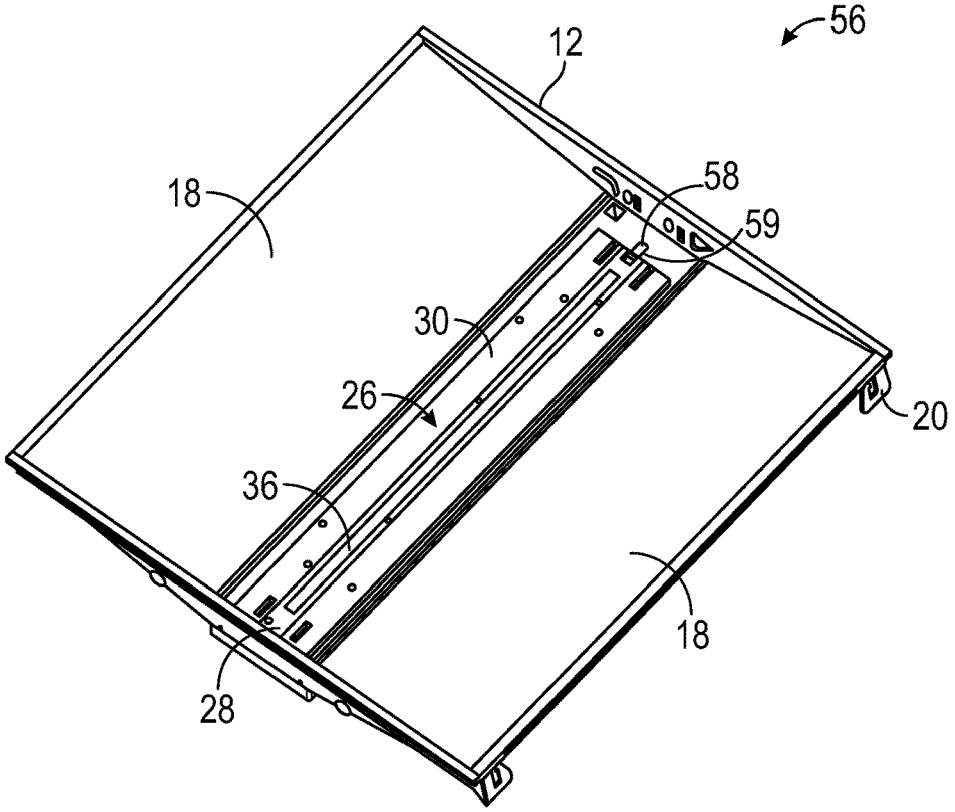
FIG. 8A is frontside perspective view of a lighting fixture that includes a shaped structure configured to provide identification of compatible LED modules that may be used as replacements within the lighting fixture.
Figure 8B:
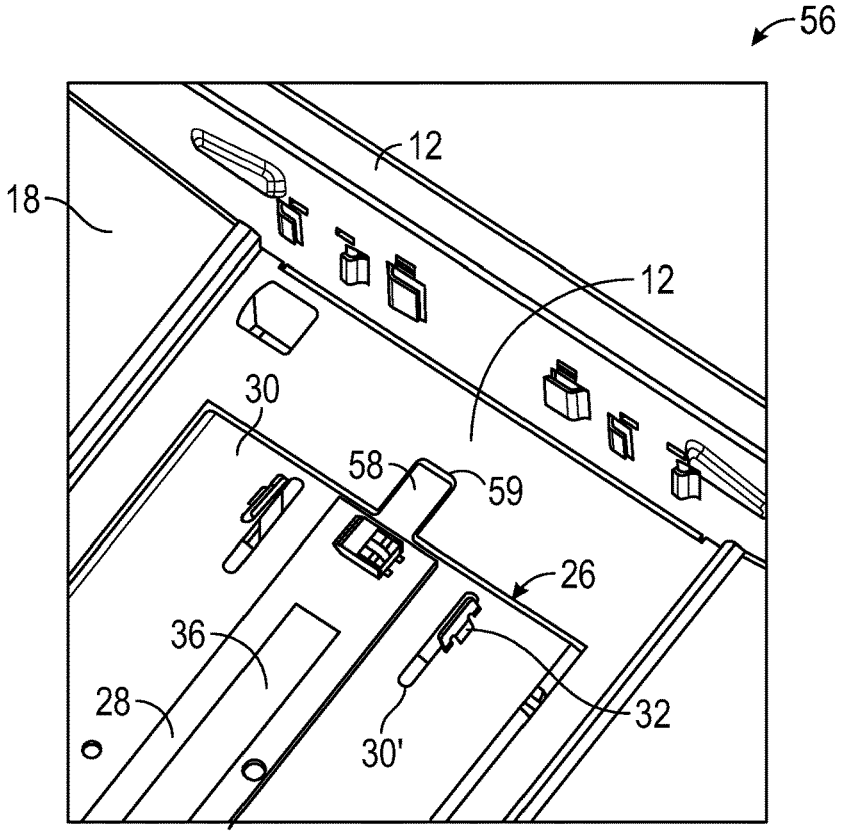
FIG. 8B is a magnified view of a portion of the lighting fixture of FIG. 8A.

FIG. 8A is frontside perspective view of a lighting fixture 56 that includes a shaped structure configured to provide identification of compatible LED modules that may be used as replacements within the lighting fixture 56. FIG. 8B is a magnified view of a portion of the lighting fixture 56 of FIG. 8A. The lighting fixture 56 is similar to the lighting fixture 10 of FIG. 3A and for illustrative purposes, the lens and the endcaps are omitted. In FIG. 8B, a portion of the retention clips 32 are visible through the openings 30'. By way of example, the LED module 26 forms a protrusion 58 from one or more of the module housing 30 and the LED board 28. When the LED module 26 is attached, the protrusion 58 aligns with a corresponding cut-out shape 59 formed in a portion of the fixture housing 12. In FIG. 8A, the protrusion 58 and corresponding cut-out shape 59 are drawn with a simple rectangular shape. In practice, any number of simple or complex shapes may be used that are designed to identify different types of replacement LED modules. For example, when an end user is ready to replace the LED module 26 of FIGS. 8A and 8B with a replacement LED module, care should be taken to ensure the replacement LED module includes a protrusion that is matched to the shape of the protrusion 58. Additionally, the protrusion 58 and corresponding cut-out shape 59 of the fixture housing 12 may provide improved alignment for attachment of the LED module 26.

Figure 9A:
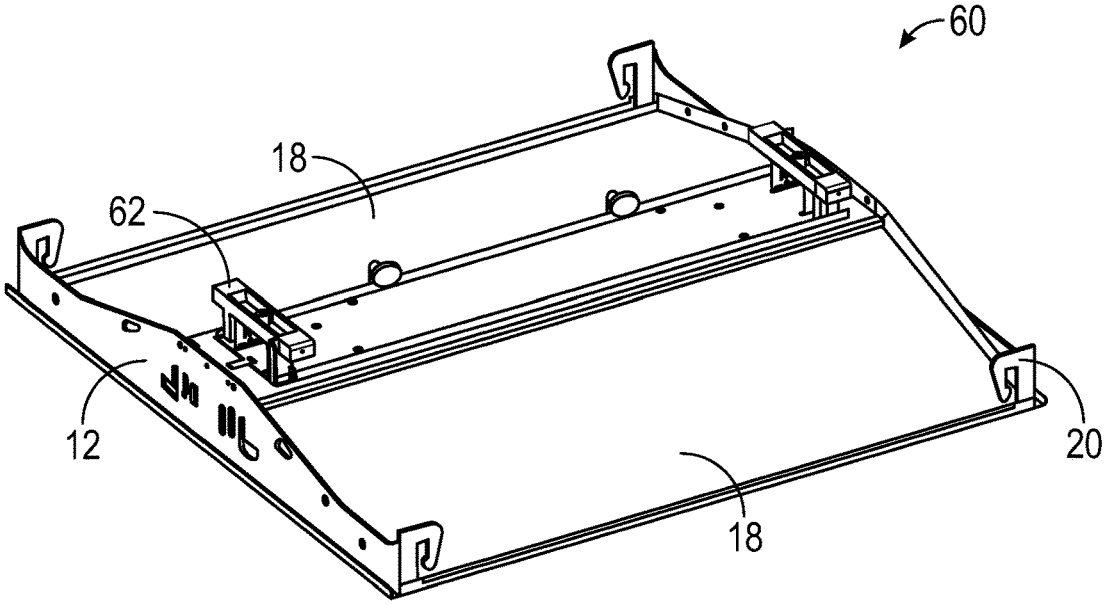
FIG. 9A is backside perspective view of a lighting fixture that is similar to the lighting fixture of FIG. 8A and includes additional shaped structures on the backside of the LED module to provide identification of compatible LED modules that may be used as replacements within the lighting fixture.
Figure 9B:
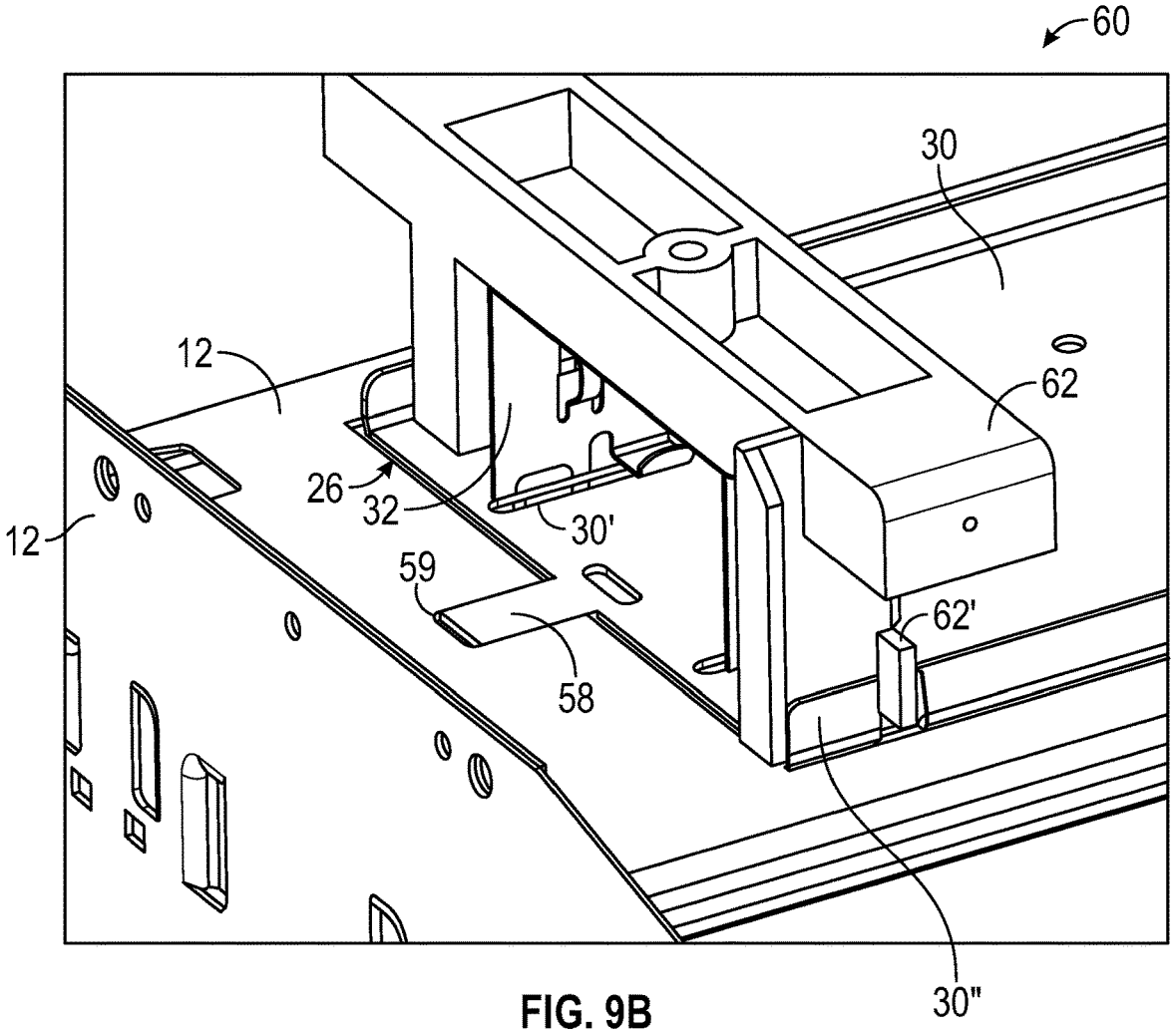
FIG. 9B is a magnified view of a portion of the lighting fixture of FIG. 9A.

FIG. 9A is backside perspective view of a lighting fixture 60 that is similar to the lighting fixture 56 and includes additional shaped structures on the backside of the LED module 26. FIG. 9B is a magnified view of a portion of the lighting fixture 60 of FIG. 9A. The lighting fixture 60 is also similar to the lighting fixture 10 of FIG. 3A and for illustrative purposes, portions of the electronics housing 22 of FIG. 3A are omitted. A bracket 62 or other support member that may be integrated with the electronics housing 22 is illustrated in FIGS. 9A and 9B. In certain embodiments, the bracket 62 may support the retention clips 32. The lighting fixture 60 may include the protrusion 58 of the module housing 30 and corresponding cut-out shape 59 of the fixture housing 12 described above for FIGS. 8A and 8B. As best illustrated in FIG. 9B, a portion 30" of the module housing 30 may form a cut-out shape that receives a corresponding shape 62' of the bracket 62, thereby providing an additional shaped structure for replacement LED module matching and alignment. By way of example, the portion 30" of the module housing 30 that forms the cut-out shape may be a bent lip of the module housing 30 that is received within the electronics housing 22 during attachment. While the bracket 62 is illustrated as a separate part in FIGS. 9A and 9B, the bracket 62 may embody an integral single piece with the electronics housing 22 of FIG. 3A.

Figure 10:
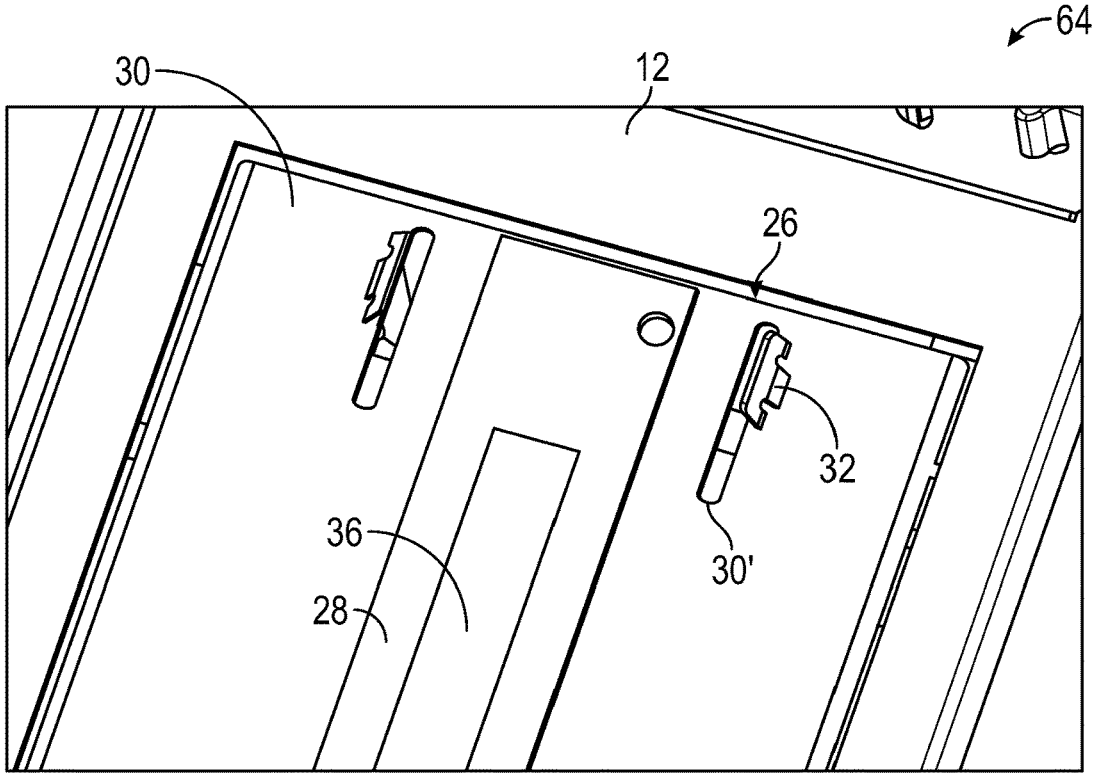
FIG. 10 is a frontside perspective view of a lighting fixture where a shape of the openings formed in the module housing provides an identification shape for the LED module to determine compatible LED modules that may be used as replacements within the lighting fixture.

FIG. 10 is a frontside perspective view of a lighting fixture 64 where a shape of the openings 30' formed in the module housing 30 provides an identification shape for the LED module 26 to determine compatible LED modules that may be used as replacements within the lighting fixture 64. By way of example, the openings 30' illustrated in FIG. 10 are formed with an elongated shape with rounded ends that may identify a particular type of LED module 26. In certain embodiments, the retention clips 32 may be provided with a shape that may only fit within the shape of the openings 30'. In practice, any number of simple or complex shapes may be used for the openings 30' and the retention clips 32 (or other mechanical fasteners) that are designed to ensure proper selection of replacement LED modules.

As previously described, aspects of the present disclosure provide lighting fixtures with modular components, such as LED modules, that may easily be replaced and/or upgraded after installation. In certain implementations, it may be desirable to provide an installed lighting fixture with more advanced control and/or communication mechanisms. For example, replaceable LED modules as described herein may include electronics configured to receive, collect, process, and/or communicate information from sensors within the particular fixture or from other fixtures and/or sensors within a distributed lighting network. In this manner, upgrading the lighting fixture according to principles of the present disclosure may include replacing one or more of the endcaps by themselves and/or together with replacement LED modules.

Figure 11A:
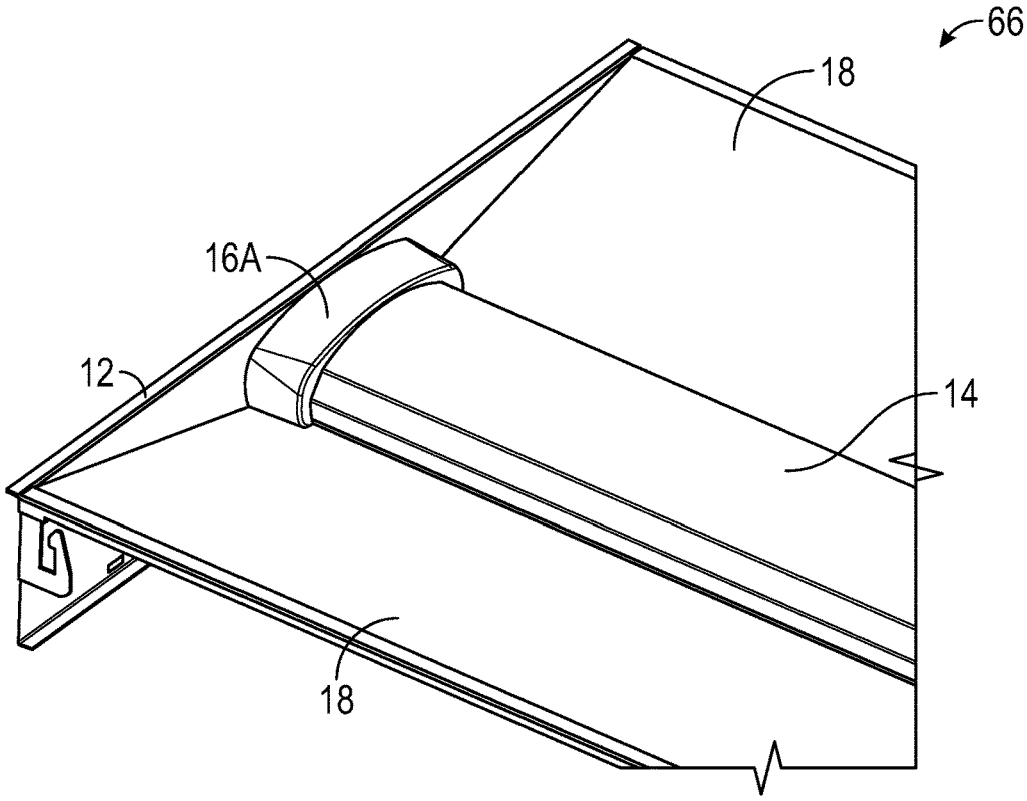
FIG. 11A is a frontside perspective view of an exemplary lighting fixture that is configured with a standard endcap according to embodiments of the present disclosure.
Figure 11B:
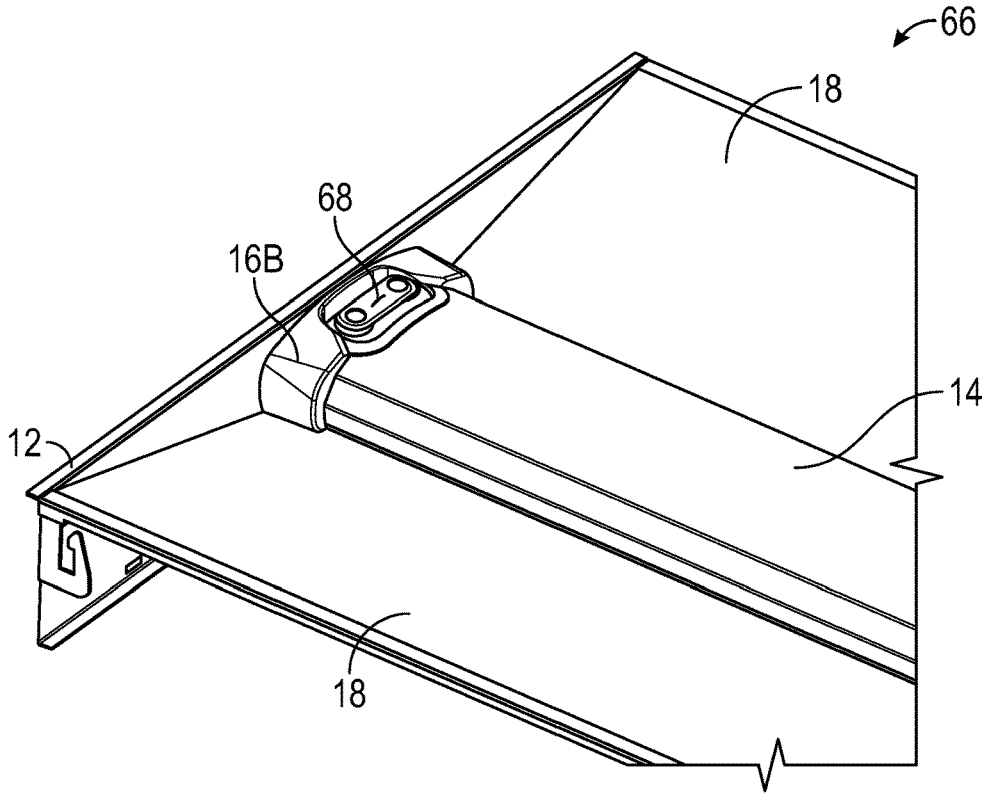
FIG. 11B is a frontside perspective view of the exemplary lighting fixture of FIG. 11A that is configured with an endcap that includes a sensor module according to embodiments of the present disclosure.
Figure 11C:
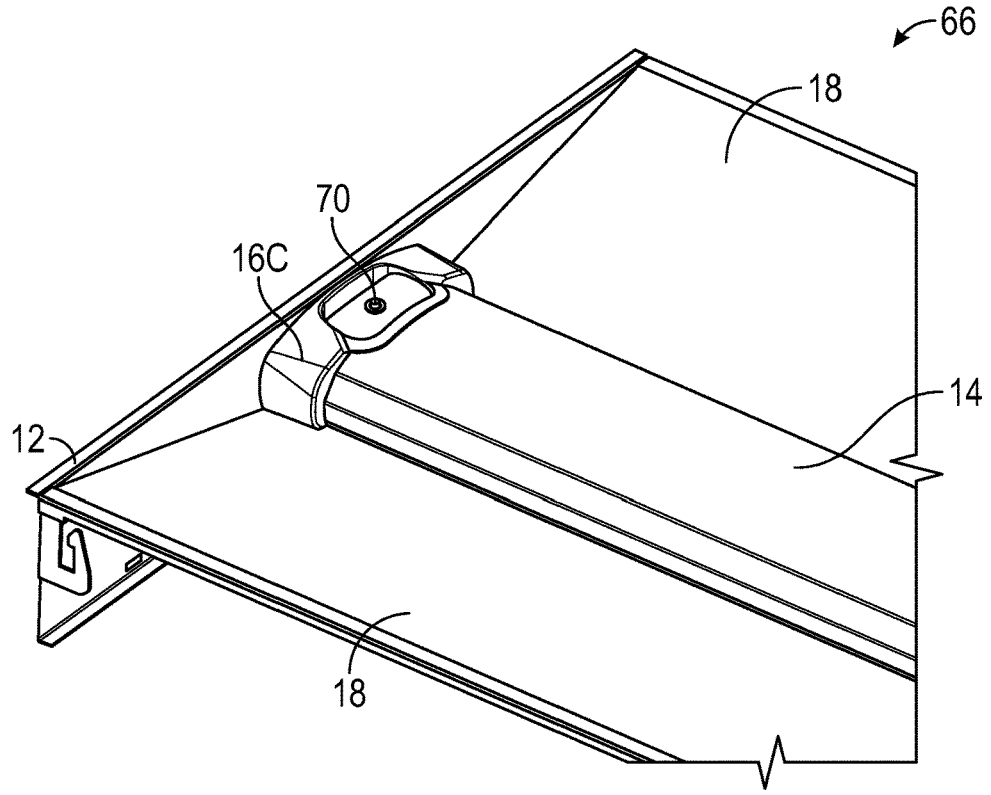
FIG. 11C is a frontside perspective view of the exemplary lighting fixture of FIG. 11A that is configured with an endcap that includes an emergency battery test button according to embodiments of the present disclosure.

FIGS. 11A-11C are frontside perspective views of an exemplary lighting fixture 66 that may be configured with any number of endcaps 16A-16C according to embodiments of the present disclosure. In FIG. 11A, the endcap 16A is a standard endcap that may be provided with a similar structure to the endcaps 16-1 to 16-2 of previous embodiments (e.g., FIG. 2). In FIG. 11B, the endcap 16B includes at least one sensor module 68. The sensor module 68 may include one or more sensors configured to provide occupancy, ambient light, light output, and temperature measurements, among others. In further embodiments, the sensor module 68 may also comprise a camera. When upgrading the LED module of the lighting fixture 66 as previously described, the endcap 16B may be provided on one or both ends of the lens 14. For embodiments where the endcap 16B is only provided on one end of the lens 14, the endcap 16A of FIG. 11A may be arranged on an opposite end of the lens 14. In FIG. 11C, the endcap 16C includes an emergency battery test button 70. In certain embodiments where the LED module of the lighting fixture 66 includes an emergency backup generator or battery (e.g., 34-3 of FIG. 5B), it may be necessary to provide room side testing capabilities for the emergency backup generator. In this regard, the emergency battery test button 70 may be provided in the endcap 16C. In practice and depending on the original configuration and/or the upgraded configuration of the lighting fixture 66, any combination of endcaps 16A-16C may be provided. In one example, the lighting fixture 66 may include a first endcap as configured in FIG. 11B and a second endcap as configured in FIG. 11C. In still further embodiments, the lighting fixture 66 may include a first endcap that is arranged with either the endcap of FIG. 11B or FIG. 11C, and a second endcap that may include other features, including but not limited to one or more of a speaker, a microphone, a universal serial bus port, an odor-releasing device, and an indicator light. The universal serial bus port may allow a user to attach any external device to the endcap. The odor-releasing device may be configured to provide a scent, such as lavender, to a space below. The indicator light may include a warning light, such as one or more of a flashing light and a color-coded light. The indicator light may also include an LED and/or a laser configured to project an image on a floor below, for example an arrow indicating an evacuation direction in an emergency event.

Modular lighting fixtures of the present disclosure may further provide many advantageous manufacturing and supply chain benefits over conventional lighting fixtures, including reduced stocking storage requirements for manufacturers and end users since only smaller modular elements of the lighting fixtures would need to be stored, rather than whole luminaires. In this regard, distribution of such lighting fixtures would not necessarily require a large number of unique stock keeping units (SKUs) for all of the various electrical and optical configurations for different lighting applications. Rather, lighting fixtures could be built by assembling modular components including LED modules, lenses, and endcaps to a desired application. This may also provide reduced shipping volume and costs, and provide more flexible logistical support at the worksite, as the modular components would be significantly smaller than whole lighting fixtures.

It is contemplated that any of the foregoing aspects, and/or various separate aspects and features as described herein, may be combined for additional advantage. Any of the various embodiments as disclosed herein may be combined with one or more other disclosed embodiments unless indicated to the contrary herein.

Those skilled in the art will recognize improvements and modifications to the preferred embodiments of the present disclosure. All such improvements and modifications are considered within the scope of the concepts disclosed herein and the claims that follow.

What is claimed is:

1. A lighting fixture comprising:

a fixture housing; and a light-emitting diode (LED) module that is attached to the fixture housing, wherein the LED module comprises at least one protrusion that resides within a corresponding cut-out portion of the fixture housing to provide identification of the LED module.

2. The lighting fixture of claim 1, wherein the LED module is configured for tool-less attachment and detachment to the fixture housing.

3. The lighting fixture of claim 2, wherein the LED module further comprises:

at least one LED emitter on a frontside of the LED module, the at least one LED emitter operable to emit light when energized through an electrical path; and electronics for driving the at least one LED emitter, the electronics mounted on a backside of the LED module and positioned within an electronics housing of the fixture housing.

4. A lighting fixture comprising:

a fixture housing, wherein a portion of the fixture housing includes an electronics housing; and a light-emitting diode (LED) module that is configured for tool-less attachment and detachment to the electronics housing, the LED module comprising:

at least one LED emitter on a frontside of the LED module, the at least one LED emitter operable to emit light when energized through an electrical path; and electronics for driving the at least one LED emitter, the electronics mounted on a backside of the LED module and positioned within the electronics housing when the LED module is attached;

wherein the fixture housing forms a shaped structure and the LED module forms a corresponding cut-out portion that are configured to provide identification of replacement modules that may be attached to the fixture housing.

5. The lighting fixture of claim 4, wherein the electronics comprise one or more of an LED driver, a transformer, and an emergency backup battery.

6. The lighting fixture of claim 4, further comprising one or more mechanical fasteners within the electronics housing, the one or more mechanical fasteners configured to receive the LED module.

7. The lighting fixture of claim 6, wherein the one or more mechanical fasteners are an integral single piece with the electronics housing.

8. The lighting fixture of claim 4, further comprising an electromechanical connector that is configured to provide electrical and mechanical connections for the LED module, wherein the electromechanical connector comprises a receptacle that is mounted on one of the LED module and the electronics housing and a plug that is mounted on the other of the LED module and the electronics housing.

9. The lighting fixture of claim 8, wherein the electromechanical connector provides tool-less attachment and detachment at a first location of the LED module and one or more mechanical fasteners provide tool-less attachment and detachment at a second location of the LED module.

10. A lighting fixture comprising:

a fixture housing, wherein a portion of the fixture housing includes an electronics housing; and a light-emitting diode (LED) module that is configured for tool-less attachment and detachment to the electronics housing, wherein electrical connections between the LED module and the electronics housing are configured to be connected with attachment and disconnected with detachment of the LED module to the electronics housing, the LED module comprising:

at least one LED emitter on a frontside of the LED module, the at least one LED emitter operable to emit light when energized through an electrical path;

electronics for driving the at least one LED emitter, the electronics mounted on a backside of the LED module and positioned within the electronics housing when the LED module is attached; and one or more safety tethers that are configured to provide mechanical support during the tool-less attachment and detachment.

11. The lighting fixture of claim 10, wherein an overall height of the lighting fixture is in a range from 4 inches to 5 inches and a height of the electronics housing is in a range from 1 inch to 2 inches.

12. The lighting fixture of claim 10, wherein the electronics comprise one or more of an LED driver, a transformer, and an emergency backup battery.

13. The lighting fixture of claim 10, wherein the fixture housing forms a shaped structure and the LED module forms a corresponding cut-out portion that are configured to provide identification of replacement modules that may be attached to the fixture housing.

14. The lighting fixture of claim 10, wherein the lighting fixture is a troffer lighting fixture.

15. The lighting fixture of claim 10, wherein the LED module forms a shaped structure and the fixture housing forms a corresponding cut-out portion that are configured to provide identification of replacement modules that may be attached to the fixture housing.

16. The lighting fixture of claim 15, wherein the shaped structure comprises a protrusion from the LED module.

17. The lighting fixture of claim 10, further comprising an electromechanical connector that is configured to provide electrical and mechanical connections for the LED module.

18. The lighting fixture of claim 17, wherein the electromechanical connector comprises a receptacle that is mounted on one of the LED module and the electronics housing and a plug that is mounted on the other of the LED module and the electronics housing.

19. The lighting fixture of claim 17, wherein the electromechanical connector provides tool-less attachment and detachment at a first location of the LED module and one or more mechanical fasteners provide tool-less attachment and detachment at a second location of the LED module.

20. The lighting fixture of claim 10, further comprising one or more mechanical fasteners within the electronics housing, the one or more mechanical fasteners configured to receive the LED module.

21. The lighting fixture of claim 20, wherein the LED module comprises a module housing with one or more openings, and portions of the one or more mechanical fasteners reside within the one or more openings when the LED module is attached.

22. The lighting fixture of claim 20, wherein the one or more mechanical fasteners comprise one or more retention clips.

23. The lighting fixture of claim 20, wherein the one or more mechanical fasteners are attached to the electronics housing.

24. The lighting fixture of claim 20, wherein the one or more mechanical fasteners are an integral single piece with the electronics housing.

25. The lighting fixture of claim 10, further comprising:

a lens; and a first endcap and a second endcap that are configured to releasably connect the lens to the fixture housing.

26. The lighting fixture of claim 25, wherein one of the first endcap and the second endcap comprises an emergency battery test button.

27. The lighting fixture of claim 26, wherein the other of the first endcap and the second endcap comprises a sensor module.

* * * * *